US005202213A

United States Patent [19]

Nakahara et al.

[11] Patent Number: 5,202,213

[45] Date of Patent: Apr. 13, 1993

[54] DEVELOPER WITH SURFACE TREATED SILICIC ACID FOR DEVELOPING ELECTROSTATIC IMAGE

[75] Inventors: Toshiaki Nakahara, Tokyo; Hirohide Tanikawa, Yokohama; Satoshi Yoshida, Kawasaki; Masatsugu Fujiwara, Yokohama; Kiichiro Sakashita, Inagi, all of Japan

[73] Assignee: Canon Kabushiki Kaisha, Tokyo, Japan

[21] Appl. No.: 823,331

[22] Filed: Jan. 21, 1992

Related U.S. Application Data

[63] Continuation of Ser. No. 398,397, Aug. 25, 1989, abandoned.

[30] Foreign Application Priority Data

Aug. 31, 1988 [JP] Japan ..... 63-215162

[51] Int. Cl.[5] ..... G03G 9/097

[52] U.S. Cl. ..... 430/110; 430/111

[58] Field of Search ..... 430/110, 111

[56] References Cited

U.S. PATENT DOCUMENTS

| | | | |
|---|---|---|---|
| 2,221,776 | 11/1940 | Carlson . | |
| 2,297,691 | 10/1942 | Carlson . | |
| 2,618,552 | 11/1952 | Wise . | |
| 2,874,063 | 2/1959 | Greig . | |
| 2,986,521 | 5/1961 | Wielicki . | |
| 3,392,139 | 4/1968 | Dingman . | |
| 3,909,258 | 9/1975 | Kotz . | |
| 4,640,882 | 2/1987 | Mitsuhashi et al. | 430/110 |
| 4,663,263 | 5/1987 | Ikeda et al. | 430/110 |
| 4,702,986 | 10/1987 | Imai et al. | 430/120 |

FOREIGN PATENT DOCUMENTS

| | | |
|---|---|---|
| 63-73271 | 4/1988 | Japan . |
| 63-139366 | 6/1988 | Japan . |
| 1402010 | 8/1975 | United Kingdom . |
| 2052774 | 1/1981 | United Kingdom . |
| 2114312 | 8/1983 | United Kingdom . |
| 1347318 | 2/1984 | United Kingdom . |
| 2128764 | 5/1984 | United Kingdom . |
| 2144555 | 3/1985 | United Kingdom . |
| 2166881 | 5/1986 | United Kingdom . |
| 2170917 | 8/1986 | United Kingdom . |

OTHER PUBLICATIONS

Patent Abstracts of Japan, vol. 12, No. 399 (P-775) [3246], Oct. 24, 1988.

Patent Abstracts of Japan, vol. 12, No. 300 (P-745) [3147], Aug. 16, 1988.

*Primary Examiner*—Roland Martin

*Attorney, Agent, or Firm*—Fitzpatrick, Cella, Harper & Scinto

[57] ABSTRACT

A developer for developing electrostatic latent images, comprising a mixture of toner and fine powder of silicic acid wherein the mixture has a ratio of B/A of 0.9 or larger provided that the mixture contains A wt. % thereof of the silicic acid fine powder, and contains B wt. % thereof of the silicic acid fine powder after the mixture has been passed through a 200 mesh-sieve.

24 Claims, 8 Drawing Sheets

DEVELOPER WITH SURFACE TREATED SILICIC ACID FOR DEVELOPING ELECTROSTATIC IMAGE

This application is a continuation of application Ser. No. 07/398,397 filed Aug. 25, 1989, now abandoned.

FIELD OF THE INVENTION AND RELATED ART

The present invention relates to a developer for developing a latent image to be formed in image forming methods, such as electrophotography, electrostatic recording, electrostatic printing, and magnetic recording.

Hitherto, a large number of electrophotographic processes have been known, as disclosed in U.S. Pat. No. 2,297,691, etc. In these processes, an electric latent image is formed on a photosensitive member comprising a photoconductive material by various means, then the latent image is developed and visualized with a toner, and the resultant toner or developer image is, after transferred onto a transfer material such as paper, etc., as desired, fixed by heating, pressing, heating and pressing, solvent vapor to obtain copies. When the step of transferring the toner images is adopted, it is a general practice to provide a cleaning step for removing residual toner on the photosensitive member.

Various developing methods for visualizing electrostatic latent images have also been known. For example, there have been known the magnetic brush method as disclosed in U.S. Pat. No. 2,874,063; the cascade developing method as disclosed in U.S. Pat. No. 2,618,552; the powder cloud method as disclosed in U.S. Pat. No. 2,221,776: in addition, a method using an electroconductive magnetic toner as disclosed in U.S. Pat. No. 3,909,258, and a method using an insulating magnetic toner as disclosed in Japanese Patent Publication (KOKOKU) No. 9475/1966.

As the developer to be applied for these developing methods, fine powder of natural or synthetic resins having dyes or/and pigments dispersed therein has heretofore generally been used. For example, a colorant is dispersed in a binder resin such as polystyrene, and the particles obtained by micropulverizing the resultant dispersion into sizes of about 1 to 30 microns are used as the toner or developer. As the magnetic developer, there have been used magnetic particles such as magnetite and ferrite are further incorporated into the particles as mentioned above. In case of the system employing the two-component developer, the developer as mentioned above is used generally in mixture with carrier particles such as glass beads, iron particles, and ferrite particles.

It is known that silicic acid fine powder produced by a dry process or wet process is imparted to the surface of toner particles by drying mixing in order to impart sufficient triboelectric charge to a toner (hereinafter, a developer before silicic acid fine powder is dry-mixed therewith is referred to as "toner") and to enhance transfer efficiency. However, since the silicic acid fine powder per se is hydrophilic, it can deteriorate the environmental characteristic of the developer, and considerably decreases the resultant image density, particularly under high temperature-high humidity conditions.

In order to solve such a problem, there have been proposed several methods for surface-treating silicic acid fine powder to impart hydrophobicity thereto, as disclosed in Japanese Patent Publication No. 16219/1979, Japanese Laid-Open Patent Application (KOKAI) Nos. 120041/1980 and 186751/1983. In these references, silicic acid fine powder is surface-treated with various coupling agents, and the resultant hydrophobic silicic acid fine powder is contained in a developer.

In order to further impart hydrophobicity to silicic acid fine powder and to control chargeability thereof, there have been proposed developers containing silicic acid fine powder surface-treated with various silicone oils or modified silicone oils, as disclosed in Japanese Laid-Open Patent Application Nos. 60754/1983 and 201063/1984.

However, in a case where the above-mentioned silicic acid fine powder is imparted to the surface of toner particles by means of a dry-mixing machine generally used in the prior art thereby to prepare a developer, which is then subjected to successive copying for a long period, a so-called "filming phenomenon" occurs on the surface of a photosensitive member, whereby an image defect such as fog, spots and staining is liable to occur in the resultant image.

Recently, as image forming apparatus such as electrophotographic copying machines have widely been used, their uses have also extended in various ways, and higher image quality has been demanded In order to enhance the image quality of copied images, there has been proposed a two-component developer containing a toner having a specific particle size distribution and a volume-average particle size than which is smaller than that in the prior art (Japanese Laid-Open Patent Application No. 129437/1983). However, in a case where silicic acid fine powder is dry-mixed with such a toner having a particle size smaller than that in the prior art to obtain a developer, which is then used for image formation, the above-mentioned filming phenomenon is more liable to occur.

SUMMARY OF THE INVENTION

An object of the present invention is to provide a developer which has solved the above-mentioned problems encountered in the prior art.

Another object of the present invention is to provide a developer which causes substantially no filming on a photosensitive member and is capable of providing clear images free of (or reduced in) fog, spots or stains, even when successive image formation is conducted for a long period by using an original having a large proportion of image area.

A further object of the present invention is to provide a developer which is capable of suppressing the occurrence of filming on a photosensitive member and is capable of providing images having a high image density and excellent thin-line reproducibility and gradational characteristic.

As a result of our study, we have found that when the above-mentioned conventional developer containing surface-treated silicic acid fine powder which has been imparted thereto by a conventional dry mixing device is subjected to successive image formation for a long period, the silicic acid fine powder is attached to a photosensitive member and accumulated or deposited thereon to be converted in a film state, which is liable to cause fog, spots or stains on the resultant images.

FIG. 1 is a photograph (magnification = 5,000) taken by a scanning electron microscope which shows a state wherein silicic acid fine powder is attached to a photosensitive member to cause a filming phenomenon. Particularly, when an original having a large image area proportion (i.e., one having a large proportion of an image area to the entire area) is copied, the contact area between a photosensitive member and developer particles is increased with respect to unit area of the photosensitive member, and a larger amount of silicic acid fine powder contained in the developer is attached to the photosensitive member, whereby some problems relating to the filming phenomenon are liable to occur.

It is considered that the filming can be caused by various factors However, as a result of our study, we have found that the above-mentioned phenomenon is mainly attributable to the condition of dispersion and/or attachment of silicic acid fine powder contained in a developer.

Such surface-treated silicic acid fine powder generally has a primary particle size of about 10–20 mμ (millimicron), but it assumes agglomerates or aggregates (about 5–150 microns) of primary particles, or higher agglomerates or clusters (about 30 –300 microns) formed by further agglomeration of the above-mentioned agglomerates, before it is dry-mixed with toner particles.

Photographs of surface-treated silicic acid fine powder taken by a scanning electron microscope are shown in FIG. 2 (magnification=3,000) and FIG. 3 (magnification=150).

In the dry-mixing of the silicic acid fine powder with toner particles, it is necessary to strongly attach the silicic acid fine powder to the surface of the toner particles while disintegrating the agglomerates of primary particles and the agglomerate clusters formed by further agglomeration of the agglomerates. In such dry mixing, there is generally used simple addition or mixing operation which uses a mixer such as Henschel mixer and Parpen mayer using an agitating blade (or mixing blade) at a peripheral speed of about several meters/sec to 40 m/sec. The structure of a Henschel mixer is shown in FIG. 4, as an example of the above-mentioned devices.

However, in such a mixing operation, a large difference in peripheral speed occurs between the vicinity of the central portion (i.e., vicinity of the rotating shaft) of the device and the tip portion of the agitating blade. Since the vicinity of the rotating shaft does not have a blade-like member, the agitating force partially varies and is liable to provide an uneven dispersion state. Accordingly, in such dry mixing, the above-mentioned agglomerates of primary particles of silicic acid fine powder or higher agglomerates formed by their agglomeration are less liable to disintegrate and these agglomerates are liable to remain as such in the resultant developer. Further, the silicic acid fine powder formed by the above-mentioned disintegration have a weak adhesion to the surface of toner particles, whereby it is liable to be released from the surface. As a result, when a large number of copies are produced by using the thus prepared developer, the above-mentioned agglomerates of primary particles, higher agglomerates formed by the agglomeration of the agglomerates, and silicic acid fine powder released from the surface of the developer particles are attached to the surface of a photosensitive member and deposited thereon, whereby a filming phenomenon is liable to occur.

Particularly, since silicic acid fine powder surface-treated with a silicone oil-type treating agent has a strong cohesive force between primary particles and between aggregates, the filming phenomenon is more liable to occur.

FIG. 5 shows a photograph (magnification= 10,000) of a developer taken by a scanning electron microscope wherein silicic acid fine powder is not sufficiently dispersed.

As a result of further study based on the above-mentioned knowledge, we have found that in a developer containing silicic acid fine powder disposed on the surface of toner particles, the disintegration state of agglomerates of primary particles of silicic acid fine powder, that of higher agglomerates formed by further agglomeration of the agglomerates, and the adhesion state of disintegrated silicic acid fine powder disposed on the surface of developer particles are indicated by the ratio (B/A) of a silicic acid fine powder content (A wt. %) before the passage through a specific sieve and that (B wt. %) after the passage through the sieve, both of which are measured according to a specific method.

The developer for developing electrostatic latent images according to the present invention is based on the above-mentioned discovery and comprises: a mixture of a toner and fine powder of silicic acid; the mixture having a ratio of B/A of 0.9 or larger provided that the mixture contains A wt. % thereof of the silicic acid fine powder, and contains B wt. % thereof of the silicic acid fine powder after the mixture has been passed through a 200 mesh-sieve.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
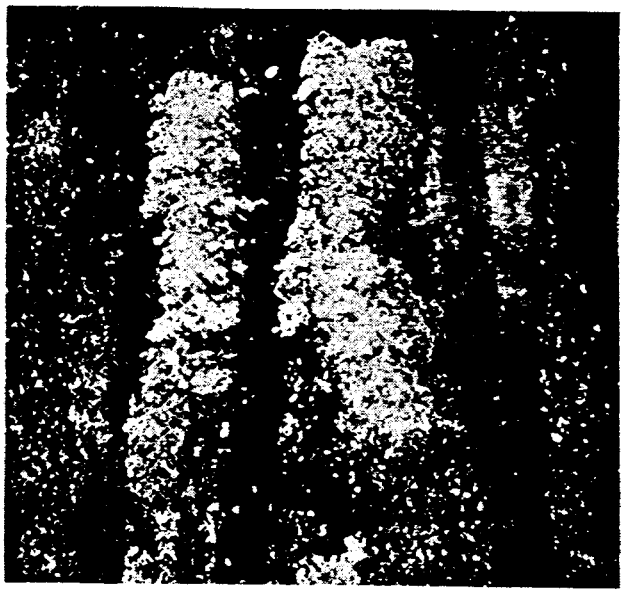
FIG. 1 is a photograph taken by a scanning electron microscope (magnification=5,000) which shows a state wherein silicic acid fine powder contained in a developer is attached to the surface of a photosensitive member to cause a filming phenomenon.
Figure 2:
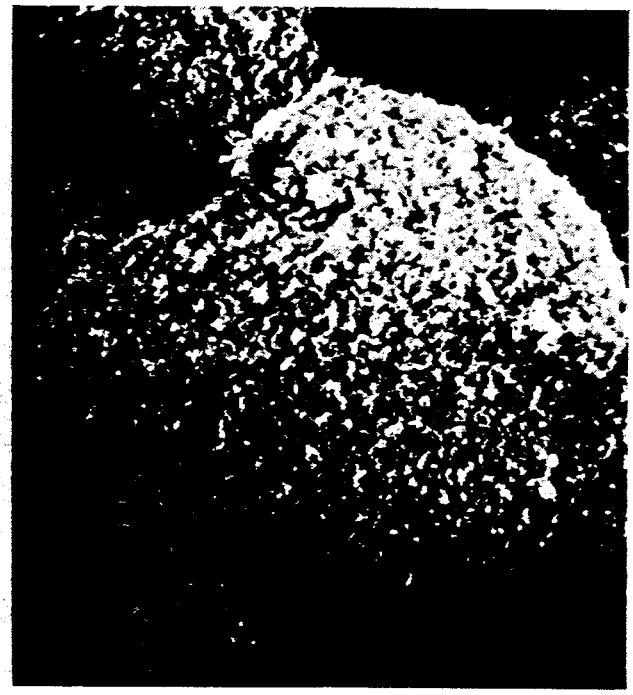
FIGS. 2 and 3 are photographs taken by a scanning electron microscope (magnification=3,000 and 150, respectively) each of which shows a surface condition of surface-treated silicic acid fine powder before dry-mixing.
Figure 3:
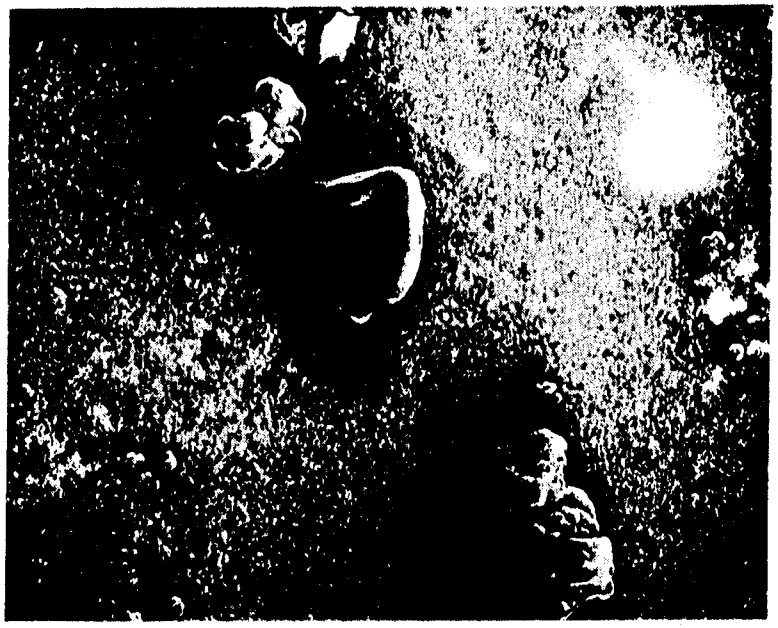

As described above, the developer of the present invention is based on the discovery that in a developer containing silicic acid fine powder disposed on the surface of toner particles, the disintegration state of agglomerates of primary particles of silicic acid fine powder, that of higher agglomerates formed by further agglomeration of the agglomerates, and the adhesion state of disintegrated silicic acid fine powder disposed on the surface of developer particles are indicated by the ratio (B/A) of a silicic acid fine powder content (A wt. %) before the passage through a specific sieve and that (B wt. %) after the passage through the sieve.

In the dry mixing operation of silicic acid fine powder and toner particles, when the silicic acid fine powder is insufficiently dispersed and mixed, a large amount of primary particle aggregates and aggregate clusters thereof which have not been disintegrated sufficiently are present in the resultant developer, and simultaneously, the adhesion between the silicic acid fine powder formed by the disintegration and toner particles is weak. Accordingly, when the developer is passed through a 200 mesh-sieve (mesh aperture 74 microns), the primary particle aggregates and aggregate clusters of silicic acid fine powder having a particle size of 74 microns or larger which have not sufficiently been disintegrated are removed, whereby the silicic acid fine powder content in the developer is decreased (i.e., the above-mentioned ratio of B/A is decreased) after it is passed through the 200 mesh-sieve.

On the other hand, when silicic acid fine powder is sufficiently dispersed and mixed, only a small amount of primary particle aggregates and aggregate clusters thereof are present in the resultant developer because of the sufficient disintegration, and simultaneously, the adhesion between the silicic acid fine powder formed by the disintegration and toner particles is strong. Accordingly, when the developer is passed through a 200 mesh-sieve in the same manner as described above, substantially no silicic acid fine powder remains on the sieve, whereby the silicic acid fine powder content in the developer is not substantially decreased after it is passed through the 200 mesh-sieve, and the above-mentioned value of B/A is nearly 1 (one).

It is not necessarily considered that the above-mentioned value of B/A directly indicates all the states of silicic acid fine powder in a developer in which the silicic acid fine powder has been incorporated by dry mixing. However, when we have conducted successive image formation for a long period by using each of developers showing various B/A values, we have experimentally found that a specific developer showing a B/A value of 0.9 or larger (more preferably 0.95 or larger) is capable of preventing the developer from adhering to a photosensitive member due to the silicic acid fine powder contained therein and is capable of enhancing the anti-filming property thereof, while a developer showing a B/A value of below 0.9 provides a large amount of adhesion or deposition on the photosensitive member due to the silicic acid fine powder and is liable to cause a filming phenomenon.

Figure 4:
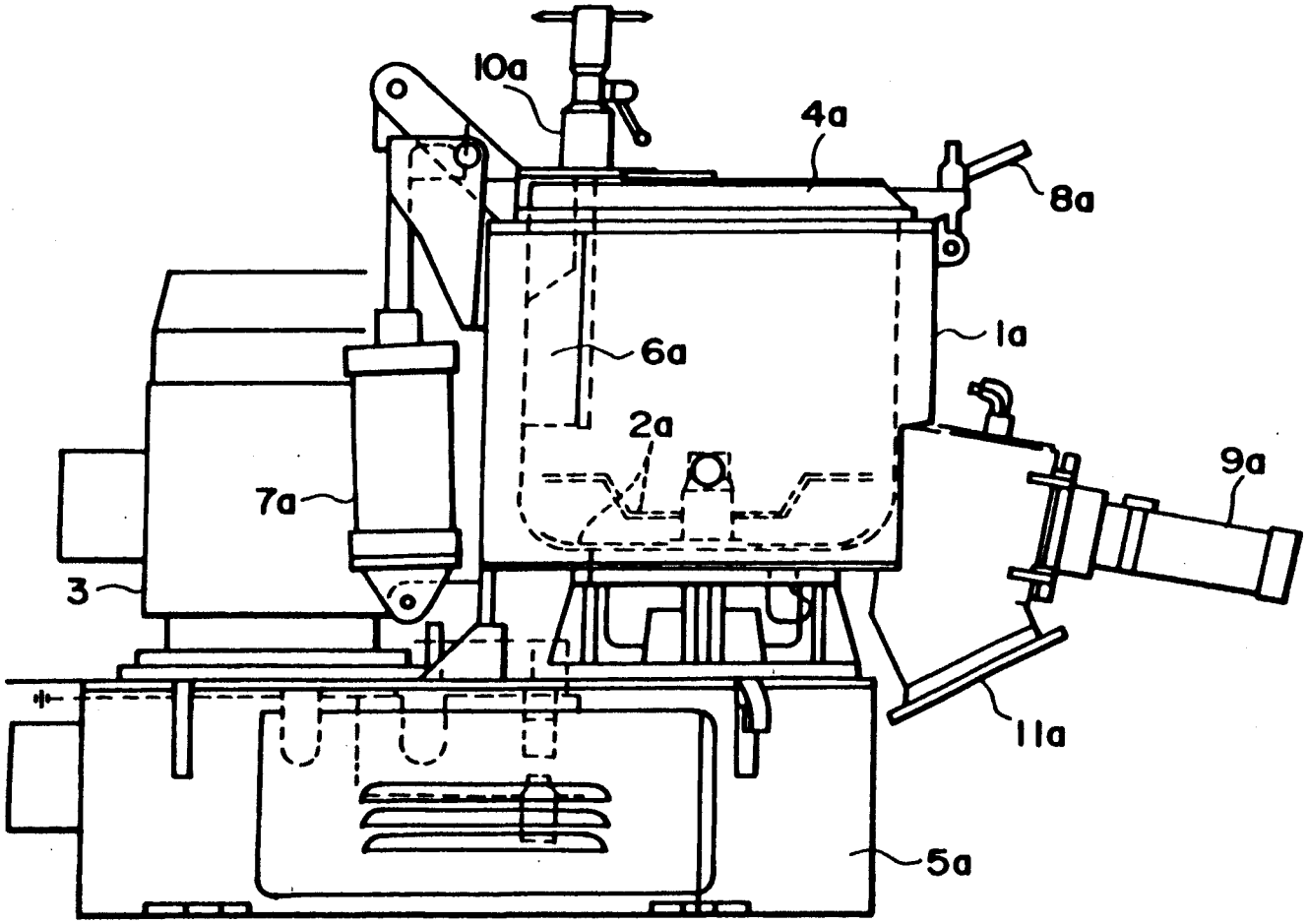
FIG. 4 is a schematic sectional view showing an example of the conventional dry-mixing apparatus (Henschel mixer)
Figure 5:
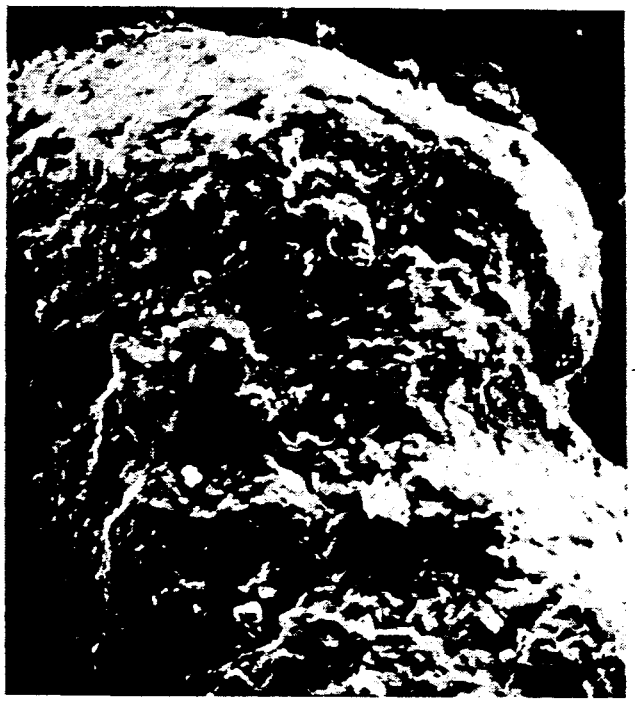
FIG. 5 is a photograph taken by a scanning electron microscope (magnification=10,000) showing a surface state of a toner particle wherein silicic acid fine powder is not sufficiently dispersed.

In order to obtain a developer having silicic acid fine powder on the surface of toner particles and having a B/A value of 0.9 or larger by dry-mixing silicic acid fine powder with toner particles, there may be used a dry-mixing method wherein mixing is conducted for a long time by using a dry-mixing device such as Henschel mixer as shown in FIG. 4 or Parpen mayer. However, such a method is not necessarily preferred because the friction between developer particles due to the long-time mixing operation generates a considerable quantity of heat so that aggregation (or agglomeration) or fusion between the developer particles is liable to occur.

Figure 6:
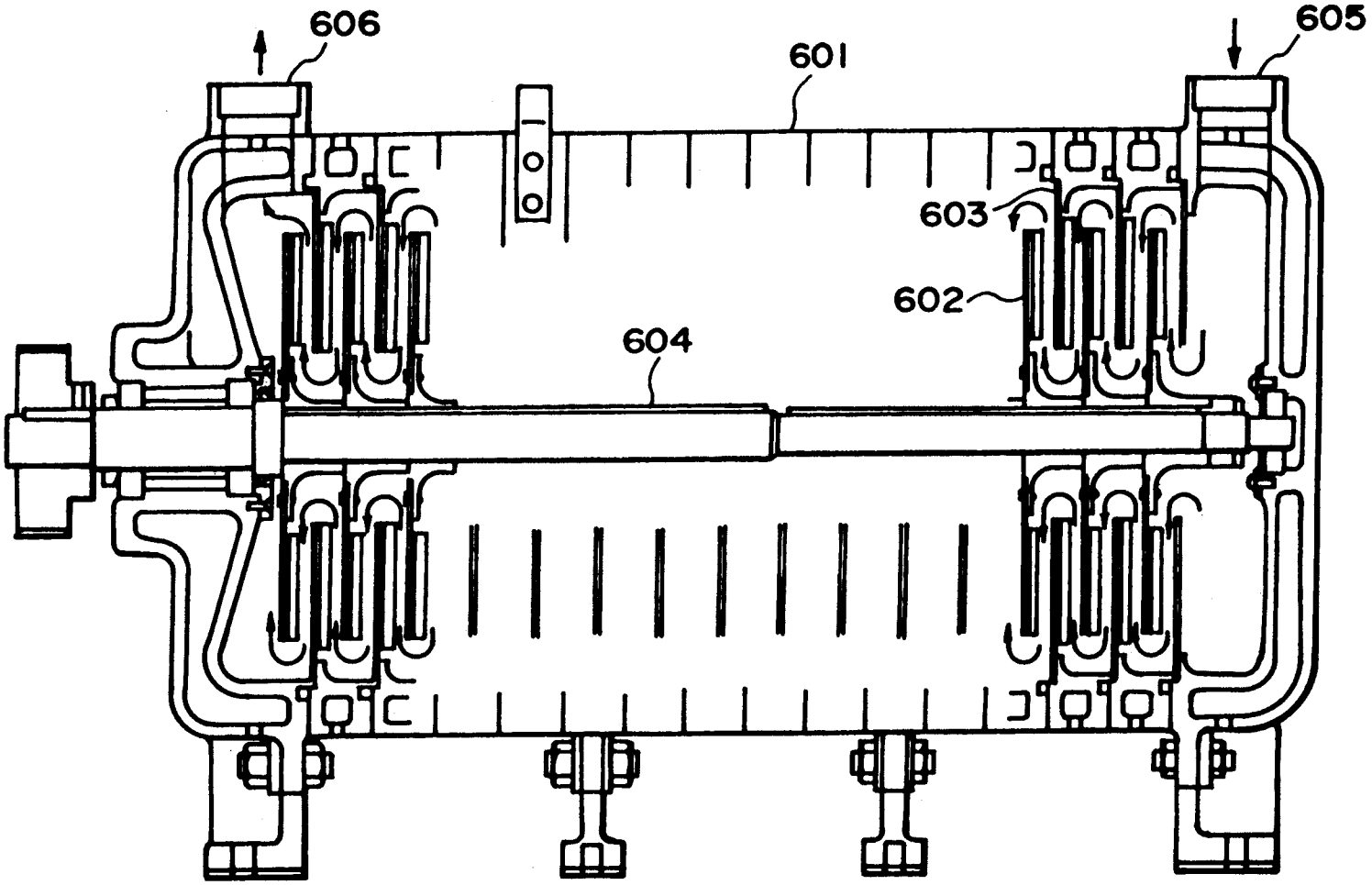
FIG. 6 is schematic sectional view showing an embodiment of the continuous mixing apparatus usable in the present invention.

In a preferred embodiment of the present invention, in order to obtain a developer having a B/A value of 0.9 or larger, the mixing operation is continuously conducted by using a mixer equipped with a plurality of multi-stage rotating mixing vanes supported by a rotating shaft. FIG. 6 is a schematic sectional view of such a continuous mixer.

Figure 7:
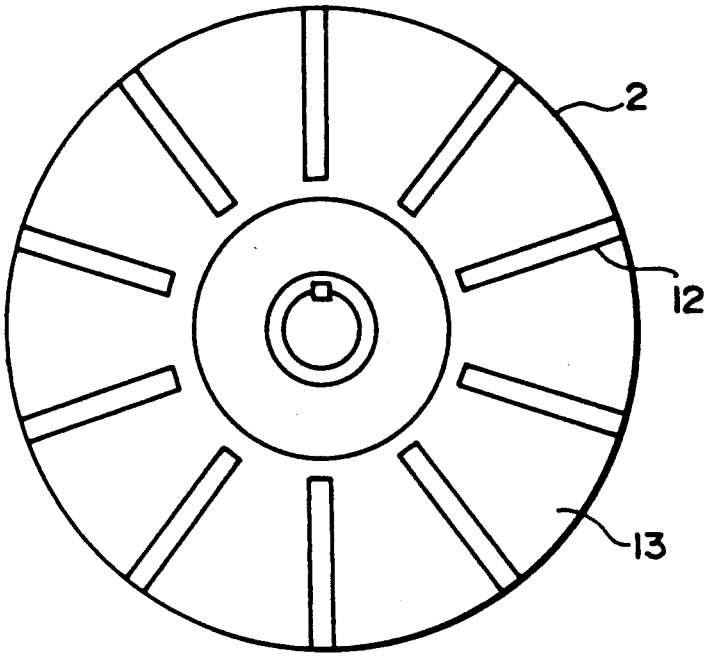
FIG. 7 is a front sectional view showing an agitating vane used in the mixing apparatus shown in FIG. 4.

Referring to FIG. 6, the continuous mixer comprises: a casing 601, a rotating vane 602 capable of high-speed rotation, a fixed blade 603 fixed to the casing 601, and a rotating shaft 604 for rotatably supporting the rotating vane 602. The mixer shown in Figure further has an inlet (or introduction) port 605 and a discharge port 606. FIG. 7 is a schematic front view of the stirring vane 602 used in the mixer as shown in FIG. 6. Referring to FIG. 7, the stirring vane 2 comprises a rotating disk 13 and a blade 12 fixed to the rotating disk 13.

In the above-mentioned mixer, a plurality of rotating vanes 602 and a plurality of fixed blades 603 are disposed in a multi-stage structure. When the stirring vane 603 is rotated at a high speed, powder introduced in the mixer is uniformly dispersed.

Toner particles and silicic acid fine powder may be introduced through the inlet port 605, dispersed and mixed by means of the stirring vane 602 rotating at a high speed and the fixed blade 603 disposed in one zone, and then sent to the next zone through a clearance formed in the fixed blade, in the neighborhood of the rotating shaft, whereby these particles are again dispersed and mixed by means of the stirring vane 602 and the fixed blade 603. The toner particles and silicic acid fine powder are conveyed while sufficiently being dispersed and mixed between the stirring vane 602 and the fixed blade 603, and finally taken out from the discharge port 606 as a developer.

Figure 8:
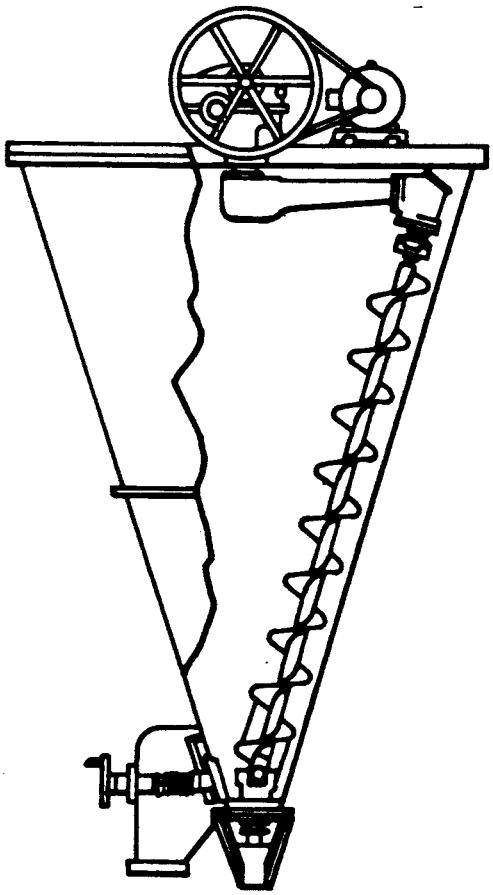
FIG. 8 is a schematic sectional view showing an embodiment of the device for pre-mixing prior to the mixing due to a continuous mixing apparatus.

In order to more effectively conduct the mixing by using the above-mentioned mixer, it is preferred to lightly stir the toner particles and silicic acid fine powder in advance, prior to the mixing using the above-mentioned mixer so that these particles may be dispersed macroscopically. When such preliminary mixing is conducted, the mixing due to the above-mentioned mixer is supplemented, and the content of primary particle aggregates and aggregate clusters of silicic acid fine powder contained in the resultant developer is further reduced, thereby to obtain a developer wherein the disintegrated and dispersed silicic acid fine powder is more firmly attached to the surface of the toner particles. The pre-mixing machine used for such a purpose may for example include an apparatus having a structure as shown in FIG. 8 (Nautor Mixer, mfd. by Hosokawa Micron K.K.).

In the mixer as shown in FIG. 6, the number of stages of the stirring vane and fixed blade may be appropriately selected corresponding to a desired state of mixing, but may preferably be three stages or more, more preferably 5–20 stages. The peripheral speed of the tip of the stirring vane 602 may preferably be 20 m/sec to 100 m/sec, more preferably 30 m/sec to 80 m/sec, in order to obtain a more desirable mixing state. The concentration of powder in the mixing operation, i.e., the rate of (the amount of the feed powder introduced into the mixer per unit time)/(the amount of air conveyed per unit time), may preferably be 0.1 kg/m$^3$ to 20 kg/cm$^3$, more preferably 1-15 kg/m$^3$.

Figure 9:
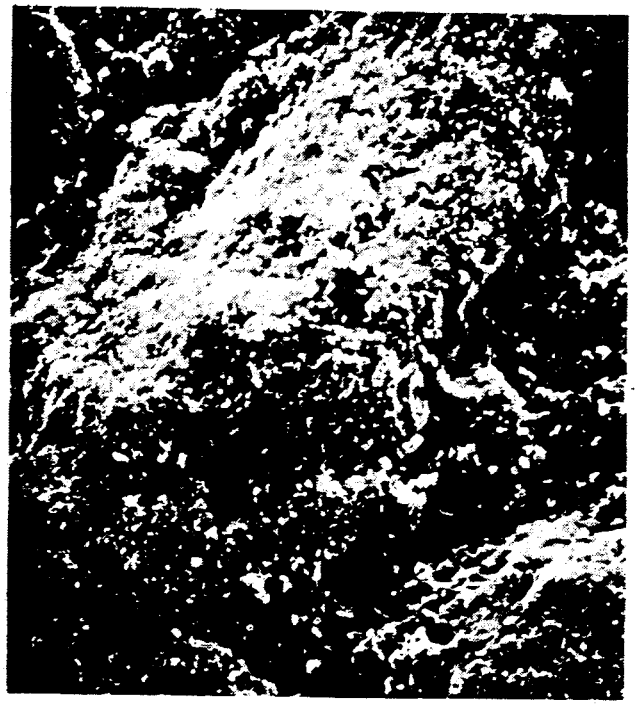
FIG. 9 is a photograph taken by a scanning electron microscope (magnification=10,000) showing a surface state wherein silicic acid fine powder is attached to the surface of toner particles by means of the dry mixing apparatus shown in FIG. 6.

In the mixer shown in FIG. 6, toner particles, silicic acid fine powder, and a mixture of the toner and the silicic acid fine powder (i.e., developer) may surely be passed through the clearance between the fixed blade and the rotating vane, and these particles are subjected to dispersing and mixing whenever they pass through the clearance, whereby mixing failure does not occur and the mixing efficiency is improved. Thus, the primary particle aggregates and aggregate clusters of the silicic acid fine powder may surely be disintegrated and the resultant silicic acid fine powder dispersed due to the disintegration may be firmly attached to the surface of the toner particles. An example of the state obtained by attaching silicic acid fine powder to the surface of toner particles by means of the above-mentioned dry mixing apparatus shown in FIG. 6 is shown in the photograph of FIG. 9 taken by a scanning electron microscope.

The above-mentioned dry-mixing method is particularly advantageous with respect to a developer for improving copied image quality which contains a toner having a relatively small volume-average particle size and a specific particle size distribution, as compared with the conventional developer, because the above-mentioned dry-mixing method particularly enhances the anti-filming property of such a developer with respect to a photosensitive member.

For example, silicic acid fine powder may be dry-mixed with a toner having a particle size distribution such that it contains 12-60% by number of toner particles having a particle size of 5 microns or smaller, contains 1-33% by number of toner particles having a particle size of 8-12.7 microns, contains 2.0% by volume or less of toner particles having a particle size of 16 microns or larger, and has a volume-average particle size of 4-10 microns, by using a mixer shown in FIG. 6 in order to improve the image quality of the resultant copied image, thereby to obtain a developer. The silicic acid fine powder contained the thus prepared developer is little attached to or deposited on a photosensitive member so that the anti-filming property is improved, although such a developer has a larger contact area with the photosensitive member per unit weight of the developer, as compared with a developer having a conventional particle size (e.g., one having a volume-average particle size of 12 microns).

A developer comprising toner particles and silicic acid fine powder attached to their surfaces by dry mixing and having a ratio of B/A of 0.9 or larger may for example be prepared in the following manner.

First, silicic acid fine powder is disintegrated by means of an impact-type micronizer (or micro-atomizer) such as Cosmomizer mfd. by Nara Kikai Seisakusho K.K. so that primary particle aggregates and aggregate clusters thereof are disintegrated, and then the resultant fine powder is mixed with toner particles to obtain a developer. In such a disintegration treatment, the silicic acid fine powder may preferably be disintegrated so that the bulk density thereof may be 5/6 to ⅓, more preferably ⅔ to ⅓, of its initial value.

In the above-mentioned silicic acid fine powder, the primary particle aggregates and aggregate clusters are decreased and the bulk density of the silicic acid fine powder is also decreased corresponding to the period of time for the disintegration treatment.

Figure 10:
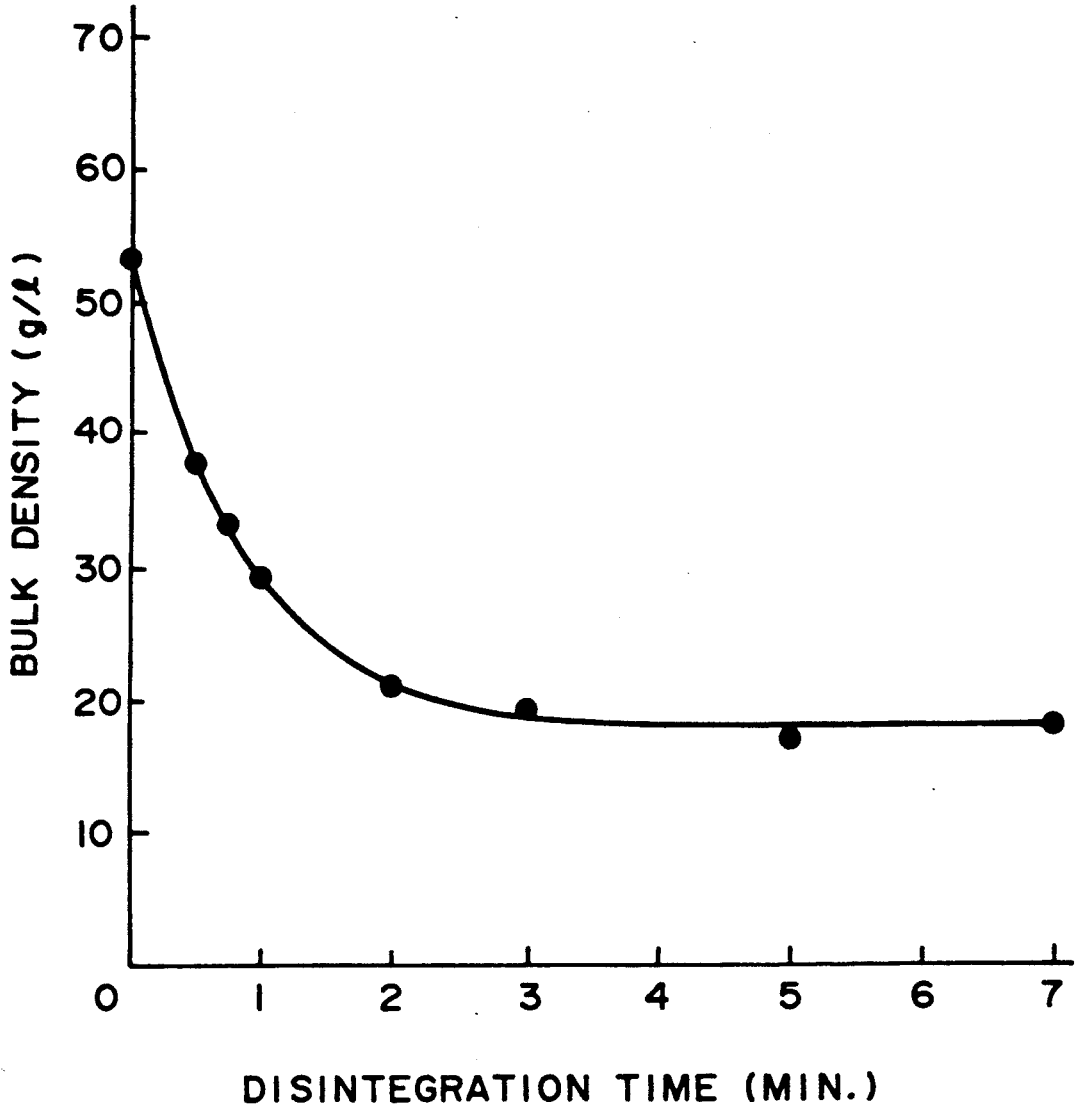
FIG. 10 is a graph showing a relationship between a change in the bulk density of surface-treated dry process synthetic silicic acid fine powder and a period of time for disintegrating the silicic acid fine powder by means of an impact-type micronizer.

FIG. 10 is a graph showing a relationship between a change in the bulk density of surface-treated silicic acid fine powder and a period of time for disintegrating the silicic acid fine powder by means of an impact-type micronizer.

The silicic acid fine powder having a low bulk density prepared in the above-mentioned manner, even when subjected to a generally dry mixing process, may be strongly attached to the vicinity of the surface of developer particles under a state such that the silicic acid fine powder assumes a state of primary particles or substantially primary particles. As a result, the resultant developer may show an improved anti-filming property with respect to a photosensitive member.

The silicic acid fine powder to be mixed with toner particles may preferably have a bulk density of 40 g/1 or lower, more preferably 15-30 g/l, in order to provide a good developer.

The bulk density used herein may be measured in the following manner.

A cylindrical container having an inside diameter of 2.52 cm, a height of 5.00 cm and a capacity of 100 cm$^3$ is statically disposed on a horizontal surface, and a sample (powder) is gently dropped into the container from a height of about 3 cm counted from the opening of the container so that the container may be filled with the sample Then, an excess of the sample powder rising from the horizontal plane of the opening is removed, and the sample contained in the container is weighed The bulk density is calculated on the basis of the thus measured weight.

In order to obtain the developer according to the present invention, the above-mentioned methods may be used in combination. The thus obtained developer may have not only a further improved anti-filming property but also an excellent characteristic such that it may retain a high image density.

In the present invention, with respect to a developer containing silicic acid fine powder attached to the surface of toner particles by dry-mixing, the silicic acid fine powder content (B wt. %) is determined by using the developer which has been passed through a 200 mesh-sieve (or screen).

In order to pass the developer through the 200 mesh-sieve, a measurement device (Powder Tester, mfd. by Hosokawa Micron K.K.) may for example be used.

More specifically, a 200 mesh-sieve having a diameter of 75 mm (mesh opening=74 microns) is set to the Powder tester, and and fixed thereto by means of a knob nut. The vibration-tapping changeover switch is set to "VIB", then the starting button is pushed to operate the vibration mount, and the rhoeostat is regulated so that the AC voltage may be 30V. Thereafter, 100 g of the developer is passed through the sieve at about 22° C. and about 65% RH under a condition such that the vibration time is about 1-2 min., thereby to obtain a developer to be used for the measurement of the silicic acid fine powder content (B wt. %).

The silicic acid fine powder content in the developer according to the present invention (A wt. %), and the silicic acid fine powder content in the developer (B wt. %) after the developer is passed through the 200 mesh-sieve may be measured by means of an X-ray fluorescence analyzer (trade name: System 3080, mfd. by Rigaku Denki K.K.) and a data processor (trade name:

Dataflex, mfd. by Rigaku Denki K.K.) converted to the analyzer.

More specifically, silicic acid fine powder used is mixed with toner particles, with which silicic acid fine powder has not been dry-mixed yet, by means of a coffee mill by external addition thereby to prepare sample developers respectively having silicic acid fine powder contents of 0.0, 0.5, 1.0 and 1.5 wt. based on the weight of the toner, which are used as samples for providing a calibration curve. Then, measurement conditions for Si are called by means of the Dataflex, and each of the above-mentioned samples for providing a calibration curve are formed into a pellet.

More specifically, a pressure of 2000 kg/cm$^2$ is applied to about 4 g of the sample of 30 sec, thereby to prepare a pellet having a thickness of about 2 mm and a diameter of about 39 mm.

Each of the thus pelletized samples is loaded in the System 3080, and is subjected to measurement while controlling the measurement conditions so that the kV-meter indicates 40 kV (accelerating voltage) and the mA-meter indicates 70 mA. In the measurement, the sample is irradiated with X-rays and a count number is measured with respect to a peak height in the range of angle of 108±2 degrees. Based on the count numbers measured in such a manner, each count number (ordinate) is plotted against the corresponding wt. % of the silicic acid fine powder contained in each sample for calibration (abscissa) with respect to the respective pelletized sample, thereby to obtain a calibration curve.

Separately, a developer wherein the silicic acid fine powder content (A wt. %) is to be measured is pelletized in the same manner as described above to prepare a Sample A. Further, a sample obtained by passing the above-mentioned developer through a 200 mesh-sieve is also pelletized to prepare a Sample B. Each of the Samples A and B is loaded in the System 3080 and the count number therefor is measured in the same manner as that in the measurement of the samples for calibration. Based on such a measurement, the above-mentioned silicic acid fine powder contents (A wt. % and B wt.%) used in the present invention are determined by using the thus measured count number and the above-mentioned calibration curve.

The silicic acid fine powder used in the present invention may be either positively chargeable silicic acid fine powder or negatively chargeable silicic acid fine powder, or may be a combination of two or more species selected from these fine powders.

The positively chargeable silicic acid fine powder may be silicic acid fine powder produced by a dry process or wet process which has been surface-treated so that it may be imparted with a positive chargeability. The negatively chargeable silicic acid fine powder may be silicic acid fine powder produced by a dry process or wet process as such (i.e., in an untreated state), or that which has been surface-treated so that it does not lose its negative chargeability.

The dry process referred to herein is a process for producing silicic acid fine powder through vapor-phase oxidation of a silicon halide. For example, silicic acid powder can be produced according to the method utilizing pyrolytic oxidation of gaseous silicon tetrachloride in oxygen-hydrogen flame, and the basic reaction scheme may be represented as follows:

$$SiCl_4+2H_2+O_2 \rightarrow SiO_2+4HCl.$$

In the above preparation step, it is also possible to obtain complex fine powder of silicic acid and other metal oxides by using other metal halide compounds such as aluminum chloride or titanium chloride together with silicon halide compounds. Such is also included in the silicic acid fine powder to be used in the present invention.

Commercially available silicic acid fine powder formed by vapor phase oxidation of a silicon halide to be used in the present invention include those sold under the trade names as shown below.

| | |
|---|---|
| AEROSIL | 130 |
| (Nippon Aerosil Co.) | 200 |
| | 300 |
| | 380 |
| | OX 50 |
| | TT 600 |
| | MOX 80 |
| | MOX 170 |
| | COK 84 |
| Cab-O-Sil | M-5 |
| (Cabot Co.) | MS-7 |
| | MS-75 |
| | HS-5 |
| | EH-5 |
| Wacker HDK | N 20 |
| (WACKER-CHEMIE GMBH) | V 15 |
| | N 20E |
| | T 30 |
| | T 40 |
| D-C Fine Silica | |
| (Dow Corning Co.) | |
| Fransol | |
| (Fransil Co.) | |

On the other hand, in order to produce silicic acid fine powder to be used in the present invention through the wet process, various processes known heretofore may be applied. For example, decomposition of sodium silicate with an acid represented by the following scheme may be applied:

$$Na_2O\ xSiO_2+HCl+H_2O \rightarrow SiO_2\ nH_2O+NaCl.$$

In addition, there may also be used a process wherein sodium silicate is decomposed with an ammonium salt or an alkali salt, a process wherein an alkaline earth metal silicate is produced from sodium silicate and decomposed with an acid to form silicic acid, a process wherein a sodium silicate solution is treated with an ion-exchange resin to form silicic acid, and a process wherein natural silicic acid or silicate is utilized.

The silicic acid fine power to be used herein may be anhydrous silicon dioxide (silica), and also a silicate such as aluminum silicate, sodium silicate, potassium silicate, magnesium silicate and zinc silicate.

Commercially available silicic acid fine powders formed by the wet process include those sold under the trade names as shown below:

Carplex (available from Shionogi Seiyaku K.K.)
Nipsil ( Nippon Silica K.K.)
Tokusil, Finesil (Tokuyama Soda K.K.)
Bitasil (Tagi Seihi K.K.)
Silton, Silnex (Mizusawa Kagaku K.K.)
Starsil (Kamishima Kagaku K.K.)
Himesil (Ehime Yakuhin K.K.)
Siloid (Fuji Devison Kagaku K.K.)
Hi-Sil (Pittsuburgh Plate Glass Co.)
Durosil, Ultrasil (Fulstoff-Gesellshaft Marquart)
Manosil (Hardman and Holden)

Hoesch (Chemische Fabrik Hoesch K-G)
Sil-Stone (Stoner Rubber Co.)
Nalco (Nalco Chem. Co.)
Quso (Philadilphia Quartz Co.)
Imsil (Illinois Minerals Co.)
Calcium Silikat (Chemische Fabrik Hoesch, K-G)
Calsil (Fullstoff-Gesellschaft Marquart)
Fortafil (Imperial Chemical Industries)
Microcal (Joseph Crosfield & Sons. Ltd.)
Manosil (Hardman and Holden)
Vulkasil (Farbenfabriken Bayer, A.G.)
Tufknit (Durham Chemicals, Ltd.)
Silmos (Shiraishi Kogyo K.K.)
Starlex (Kamishima Kagaku K.K.)
Furikosil (Tagi Seihi K.K.)

Among the above-mentioned silica powders, those having a specific surface area as measured by the BET method with nitrogen adsorption of 30 $m^2/g$ or more, particularly 50–400 $m^2/g$, provides a good result.

In order to obtain positively chargeable silicic acid fine powder, the above-mentioned (untreated) silicic acid powder obtained through the dry or wet process may be treated with a silicone oil having an organic group containing at least one nitrogen atom in its side chain, a nitrogen-containing silane coupling agent, or both of these.

In the present invention, "positively chargeable silicic acid fine powder" means one having a positive triboelectric charge with respect to iron powder carrier when measured by the blow-off method.

The silicone oil having a nitrogen atom in its side chain to be used in the treatment of silicic acid fine powder may be a silicone oil having at least the following partial structure:

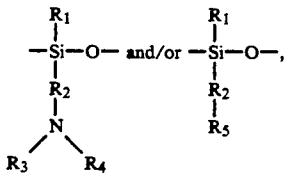

wherein $R_1$ denotes hydrogen, alkyl, aryl or alkoxyl; $R_2$ denotes alkylene or phenylene; $R_3$ and $R_4$ respectively denote hydrogen, alkyl, or aryl; and $R_5$ denotes a nitrogen-containing heterocyclic group.

The above alkyl, aryl, alkylene and phenylene group can contain an organic group having a nitrogen atom as a substituent, or have a substituent such as halogen within an extent not impairing the chargeability. The above-mentioned silicone oil may preferably be used in an amount of 0.1–100 wt. parts, per 100 wt. parts of the silicic acid fine powder.

The nitrogen-containing silane coupling agent used in the present invention generally has a structure represented by the following formula:

$$R_mSiY_n,$$

wherein R is an alkoxy group or a halogen atom; Y is an amino group or an organic group having at least one amino group or nitrogen atom; and m and n are positive integers of 1–3 satisfying the relationship of $m+n=4$. The nitrogen-containing silane coupling agent may preferably be used in an amount of 0.1–100 wt. parts, per 100 wt. parts of silicic acid fine powder.

The organic group having at least one nitrogen group may for example be an amino group having an organic group as a substituent, a nitrogen-containing heterocyclic group, or a group having a nitrogen-containing heterocyclic group. The nitrogen-containing heterocyclic group may be unsaturated or saturated. Examples of the unsaturated heterocyclic ring structure providing the nitrogen-containing heterocyclic group may include the following:

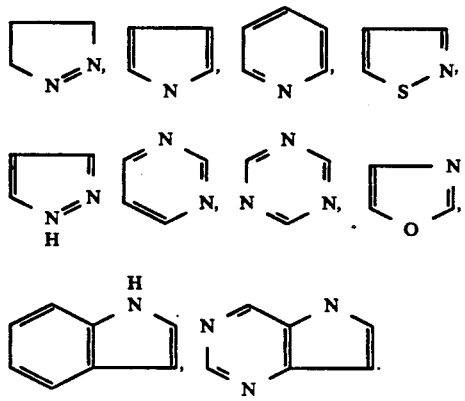

Examples of the saturated heterocyclic ring structure include the following:

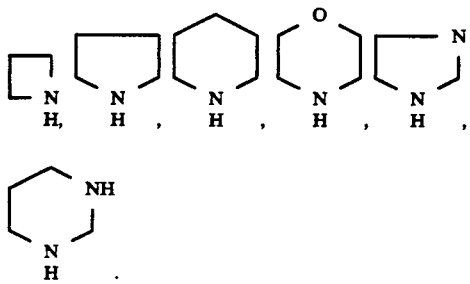

The heterocyclic groups used in the present invention may preferably be those of five-membered or six-membered rings in consideration of stability.

Examples of the silane coupling agent include:
aminopropyltrimethoxysilane,
aminopropyltriethoxysilane,
dimethylaminopropyltrimethoxysilane,
diethylaminopropyltrimethoxysilane,
dipropylaminopropyltrtimethoxysilane,
dibutylaminopropyltrimethoxysilane,
monobutylaminopropyltrimethoxysilane,
dioctylaminopropyltrimethoxysilane,
dibutylaminopropyldimethylmethoxysilane,
dibutylaminopropyldiethylmonomethoxysilane,
dimethylaminophenyltriethoxysilane,
trimethoxysilyl-γ-propylphenylamine, and
trimethoxysilyl-γ-propylbenzylamine.

Further, examples of the nitrogen-containing heterocyclic compounds represented by the above structural formulas include:
trimethoxysilyl-γ-propylpiperidine,
trimethoxysilyl-γ-propylmorpholine, and In the present invention, "negatively chargeable silicic acid fine powder" means one having a negative triboelectric charge with respect to iron powder carrier when measured by the blow-off method. The negatively chargeable silicic acid fine powder may be the above-mentioned untreated silicic acid fine powder as such. Alternatively, the silica fine powder used in the present invention may be treated as desired with a treating agent such as silane coupling agent, organic silicon compound and silicone oil for the purpose of enhancing hydrophobicity. The silicic acid fine powder may be treated with such agents so that they react with or are physically adsorbed by the silicic acid fine powder Examples of such treating agents include hexamethyldisilazane, vinyltriethoxysilane, vinyltrimethoxysilane, trimethylsilane, trimethylchlorosilane, trimethylethoxysilane, dimethyldichlorosilane, methyltrichlorosilane, allyldimethylchlorosilane, allylphenyldichlorosilane, benzyldimethylcholrosilane, bromomethyldimethylchlorosilane, α-chloroethyltrichlorosilane, β-chloroethyltrichlorosilane, chloromethyldimethylchlorosilane, triorganosilylmercaptans such as trimethylsilylmercaptan, triorganosilyl acrylates, vinylmethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxane having 2 to 12 siloxane units per molecule and containing each one hydroxyl group bonded to Si at the terminal units. These may be used alone or as a mixture of two or more compounds. The above-mentioned treating agent may preferably be used in an amount of 0.1–100 wt. parts per 100 wt. parts of the silicic acid fine powder.

In the present invention, it is preferred to use a silicone oil having a viscosity of about 5–5,000 cs (centistoke) more preferably 20–3500 cs at 25° C. Preferred examples of the silicone oil may include: methylsilicone oil, dimethylsilicon oil, phenylmethhylsilicone oil, chlorophrnylmethylsilicone oil, alkyl-modified silicone oil, fatty acid-modified silicone oil, and polyoxyalkyl-modified silicone oil. These silicone oils may be used singly or as a mixture of two or more species.

In the present invention, it is preferred to use 0.01–8 wt. parts, more preferably 0.1–5 wt. parts, of the silicic acid fine powder with respect to 100 wt. parts of the toner.

Specific examples of the binder for use in constituting the toner according to the present invention, when applied to a hot pressure roller fixing apparatus using an oil applicator may include: homopolymers of styrene and its derivatives, such as polystyrene, poly-p-chlorostyrene, and polyvinyltoluene; styrene copolymers, such as styrenep-chlorostyrene copolymer, styrene-vinyltoluene copolymer, styrene-vinylnaphthalene copolymer, styreneacrylate copolymer, styrene-methacrylate copolymer, styrene-methyl α-chloromethacrylate copolymer, styreneacrylonitrile copolymer, styrene-vinyl methyl ether copolymer, styrene-vinyl ethyl ether copolymer, styrene-vinyl methyl ketone copolymer, styrenebutadiene copolymer, styrene-isoprene copolymer, and styrene-acrylonitrile-indene copolymer; polyvinyl chloride, phenolic resin, natural resin-modified phenolic resin, natural resin-modified maleic acid resin, acrylic resin, methacrylic resin, polyvinyl acetate, silicone resin, polyester resin, polyurethane, polyamide resin, furan resin, epoxy resin, xylene resin, polyvinylbutyral, terpene resin, coumaroneindene resin and petroleum resin.

In a hot pressure roller fixing system using substantially no oil application, serious problems are provided by an offset phenomenon that a part of toner image on toner image-supporting member such as transfer material is transferred to a heating roller, and an intimate adhesion of a toner on the toner image-supporting member. As a toner fixable with a less heat energy is generally liable to cause blocking or caking in storage or in a developing apparatus, this should be also taken into consideration. With these phenomenon, the physical property of a binder resin in a toner is most concerned. According to our study, when the content of a magnetic material in a toner is decreased, the adhesion of the toner onto the toner imagesupporting member mentioned above is improved, while the offset is more readily caused and also the blocking or caking are also more liable. Accordingly, when a hot roller fixing system using almost no oil application is adopted in the present invention, selection of a binder resin becomes more serious A preferred binder resin may for example be a crosslinked styrene copolymer, or a crosslinked polyester.

Examples of comonomers to form such a styrene copolymer may include a vinyl monomer or a mixture of two or more species of vinyl monomers selected from: monocarboxylic acid having a double bond and their substituted derivatives, such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile, and acrylamide; dicarboxylic acids having a double bond and their substituted derivatives, such as maleic acid, butyl maleate, methyl maleate, and dimethyl maleate; vinyl esters, such as vinyl chloride, vinyl acetate, and vinyl benzoate; ethylenic olefins, such as ethylene, propylene, and butylene; vinyl ketones, such as vinyl methyl ketone, and vinyl hexyl ketone; vinyl ethers, such as vinyl methyl ether, vinyl ethyl ether, and vinyl isobutyl ether. As the crosslinking agent, a compound having two or more polymerizable double bonds may principally be used. Examples thereof include: aromatic divinyl compounds, such as divinylbenzene, and divinylnaphthalene; carboxylic acid esters having two double bonds, such as ethylene glycol diacrylate, ethylene glycol dimethacrylate, and 1, 3-butanediol diacrylate; divinyl compounds such as divinylaniline, divinyl ether, divinyl sulfide and divinyl sulfone; and compounds having three or more vinyl groups. These compounds may be used singly or in a mixture. The crosslinking agent may preferably be used in an amount of 0.01–5 wt. parts per 100 wt. parts of the monomer. %, based on the weight of the binder resin.

For a pressure-fixing system, a binder resin for pressure-fixable toner may be used. Examples thereof may include: polyethylene, polypropylene, polymethylene, polyurethane elastomer, ethylene-ethyl acrylate copolymer, ethylene-vinyl acetate copolymer, ionomer resin, styrene-butadiene copolymer, styreneisoprene copolymer, linear saturated polyesters and paraffins.

In the developer of the present invention, it is preferred that a charge controller may be incorporated in the developer particles (internal addition), or may be mixed with the developer particles (external addition). By using the charge controller, it is possible to most suitably control the charge amount corresponding to a developing system to be used. Particularly, in the present invention, it is possible to further stabilize the balance between the particle size distribution and the charge.

Examples of the positive charge controller may include; nigrosine and its modification products modified by a fatty acid metal salt, quaternary ammonium salts, such as tributylbenzyl-ammonium-1-hydroxy-4-naphthosulfonic acid salt, and tetrabutylammonium tetrafluoroborate; diorganotin oxides, such as dibutyltin oxide, dioctyltin oxide, and dicyclohexyltin oxide; and diorganotin borates, such as dibutyltin borate, dioctyltin borate, and dicyclohexyltin borate. These positive charge controllers may be used singly or as a mixture of two or more species. Among these, a nigrosine-type charge controller or a quaternary ammonium salt charge controller may particularly preferably be used.

As another type of positive charge controller, there may be used a homopolymer of a monomer represents by the formula:

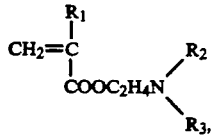

wherein $R_1$ represents H or $CH_3$; and $R_2$ and $R_3$ each represents a substituted or unsubstituted alkyl group (preferably $C_1$–$C_4$); or a copolymer of the abovementioned monomer with another polymerizable monomer such as styrene, acrylates, and methacrylates as described above. In this case, the positive charge controller also has a function of the entirely or a part of a binder.

On the other hand, a negative charge controller can be used in the present invention. Examples thereof may include an organic metal complex or a chelate compound. More specifically, there may preferably be used aluminum acetylacetonate, iron (II) acetylacetonate, and a 3,5-di-tertiary butylsalicylic acid chromium. There may more preferably be used acetylacetone metal complexes, or salicylic acid-type metal salts or complexes. Among these, salicylic acid-type metal complexes or metal salts may particularly preferably be used.

It is preferred that the above-mentioned charge controller is used in the form of fine powder, when it does not have a function of a binder. In such a case, the number-average particle size thereof may preferably be 4 microns or smaller, more preferably 3 microns or smaller.

In the case of internal addition, such a charge controller may preferably be used in an amount of 0.1–20 wt. parts, more preferably 0.2–10 wt. parts, per 100 wt. parts of a binder resin.

An additive may be mixed in the developer of the present invention as desired. More specifically, as a colorant, known dyes or pigments may be used generally in an amount of 0.5–20 wt. parts per 100 wt. parts of a binder resin. Another optional additive may be added to the developer. Optional additives to be used include, for example, lubricants such as zinc stearate; abrasives such as cerium oxide, silicon carbide and strontium titanate resin fine particles; flowability improvers such as aluminum oxide; anti-caking agent; or conductivity-imparting agents such as carbon black and tin oxide.

In order to improve releasability in hot-roller fixing, it is also a preferred embodiment of the present invention to add to the toner a waxy material such as low-molecular weight polyethylene, low-molecular weight polypropylene, microcrystalline wax, carnauba wax, sasol wax or paraffin wax, preferably in an amount of 0.5–5 wt. %.

The developer of the present invention can contain a magnetic material which may also function as a colorant. The magnetic material to be contained in the developer may be one or a mixture of: iron oxides such as magnetite, hematite, ferrite and ferrite containing excess iron; metals such as iron, cobalt and nickel, alloys of these metals with metals such as aluminum, cobalt, copper, lead, magnesium, tin, zinc, antimony, beryllium, bismuth, cadmium, calcium, manganese, selenium, titanium, tungsten and vanadium, and composition of these.

These magnetic materials may preferably be in the form of particles having an average particle size of the order of 0.1–1 micron, preferably 0.1–0.5 microns and be used in the toner in an amount of about 30–120 wt. parts, particularly 40–110 wt. parts, per 100 wt. parts of a resin component.

The developer according to the present invention may be produced by sufficiently mixing a vinyl or non-vinyl thermoplastic resin such as those enumerated hereinbefore, and optionally, magnetic powder, a pigment or dye as colorant, a charge controller, another additive, etc., by means of a mixer such as a ball mill, etc.; then melting and kneading the mixture by hot kneading means such as hot rollers, kneader and extruder to disperse or dissolve the magnetic powder, pigment or dye, charge controller, or, if any, in the melted resin; cooling and crushing the mixture; subjecting the powder product to precise classification to form toner particles, and externally adding thereto silicic acid fine powder and another external additive, as desired, by a dry mixing process, thereby to obtain the developer according to the present invention.

The photosensitive member to be used in combination with the developer of the present invention may be one comprising cadmium sulfide, selenium, zinc oxide, an organic photoconductor (OPC), amorphous silicon (α-Si), etc. In the present invention, a preferred example of the photosensitive member to be used in combination with the developer according to the present invention is one comprising an organic photoconductor (OPC) or amorphous silicon (α-Si).

When the developer of the present invention is used, the cleaning method to be used in combination therewith may include: the blade cleaning method, the fur brush cleaning method, and the magnetic brush cleaning method. In consideration of a preferred combination of the developer according to the present invention and a photosensitive member, the blade cleaning method is preferred. The image forming process using the developer of the present invention may include, as desired, a discharging step which is effected immediately before a cleaning step, so as to facilitate the removal of the developer from a photosensitive member.

Hereinbelow, the present invention will be described in further detail with reference to Examples. In the following formulations, "parts" are parts by weight.

EXAMPLE 1

| | |
|---|---|
| Styrene/butyl acrylate/divinyl benzene copolymer (copolymerization wt. ratio: 80/19.5/0.5, weight-average molecular weight: 320,000) | 100 parts |
| Tri-iron tetraoxide (average particle size = 0.2 micron) | 80 parts |
| Nigrosin (number-average particle size = about | 2 parts |

-continued

| | |
|---|---|
| 3 microns) | |
| Low-molecular weight propylene-ethylene copolymer | 4 parts |

The above ingredients were well blended in a blender and melt-kneaded at 150° C. by means of a two-axis extruder The kneaded product was cooled, coarsely crushed by a cutter mill, finely pulverized by means of a pulverizer using jet air stream, and classified by a fixed-wall type wind-force classifier (DS-type Classifier, mfd. by Nippon Pneumatic Mfd. Co. Ltd.) to obtain a classified powder product. Ultra-fine powder and coarse powder were simultaneously and precisely removed from the classified powder by means of a multi-division classifier utilizing a Coanda effect (Elbow Jet Classifier available from Nittetsu Kogyo K.K.), thereby to obtain positively chargeable black fine powder (magnetic toner) having a volume-average particle size of 8.0 microns The thus obtained toner contained 35% by number of toner particles having a particle size of 5 microns or smaller, 0.5% by volume of toner particles having a particle size of 16 microns or larger, and 13% by number of toner particles having a particle size of 8-12.7 microns.

Separately, 100 parts of silicic acid fine powder synthesized by a dry process (trade name: Aerosil; #130, mfd. by Nihon Aerosil K.K., specific surface area: 130 $m^2/g$) was stirred while retaining the temperature at about 250° C., and 20 parts of a silicone oil having an amine in its side chain (viscosity: 70cps at 25° C., amine equivalent = 830) was added thereto by spraying. Then, the resultant mixture was stirred 10 min. to obtain positively chargeable silicic acid fine powder (I) having a bulk density of 53 g/l. The resultant positively chargeable silicic acid fine powder (I) was disintegrated by means of an impact-type micronizer (Cosmomizer, mfd. by Nara Kikai Seisakusho K.K.) to obtain positively chargeable silicic acid fine powder (II) having a bulk density of 20 g/l.

100 parts of the above-mentioned black fine powder and 0.8 part of the positively chargeable silicic acid fine powder (II) were charged in a mixer (Nautor Mixer, mfd. by Hosokawa Micron K.K.) as shown in FIG. 8 and subjected to a pre-mixing operation. The resultant pre-mixed product was further subjected to a mixing operation by means of a dry mixing device as shown in FIG. 6, thereby to obtain a developer (a). In this mixing operation, the number of stages was eight with respect to the stirring vanes and fixed blades, the peripheral speed of the tip portion of the stirring vane was 50 m/sec, and the pre-mixed product was fed at a rate of about 1.7 kg/min., and was continuously subjected to the mixing operation.

The above-mentioned silicic acid fine powder content A in the developer (a) was 0.80 wt. %. After the developer was passed through a 200 mesh-screen, it showed a silicic acid fine powder content B of 0.78 wt.

Accordingly, the proportion B/A was 0.98.

The developer (a) was charged in a commercially available electrophotographic copying machine (trade name: NP 3525, mfd. by Canon K.K.) equipped with an unused organic photoconductor (OPC) photosensitive drum and subjected to initial image formation, whereby a clear image having a very high image density of 1.40 and a good resolution without fog was obtained. Further, a successive image formation test of 20,000 sheets (A-4 size) was conducted by using an original having an image area proportion of 20%, and thereafter the photosensitive drum was taken out and observed with the naked eye. As a result, it was found that the silicic acid fine powder (II) was not deposited on the photosensitive drum surface, and a filming phenomenon did not occur.

The results are shown in Table 1 appearing hereinafter.

COMPARATIVE EXAMPLE 1

100 parts of black fine powder prepared in the same manner as in Example 1 and 0.8 part of positively chargeable silicic acid fine powder (I) having a bulk density of 53 g/l were charged in a mixer (Henschel mixer) as shown in FIG. 4, and mixed at a peripheral speed of 20 m/sec for 30 sec, thereby to obtain a developer (b). The developer (b) showed a content A of 0.80 wt. % but showed a content B of 0.65 wt. %, whereby the value of B/A was 0.81.

By using the above-mentioned developer (b), an image formation test was conducted in the same manner as in Example 1. The results are shown in Table 1 appearing hereinafter.

As shown in Table 1, the images provided by the developer (b) showed a high image density but showed noticeable fog and a poor resolution. When the image formation test was further conducted, black spots due to a filming phenomenon on the photosensitive drum surface occurred in the resultant images at the time of about $0.8 \times 10^4$ sheets and thereafter. Further, after an image formation test of 20,000 sheets in total was conducted, the photosensitive drum was taken out and observed. As a result, it was found that a large amount of silicic acid fine powder (I) was attached and deposited on the photosensitive drum surface.

EXAMPLE 2

100 parts of black fine powder prepared in the same manner as in Example 1 and 0.8 part of positively chargeable silicic acid fine powder (II) having a bulk density of 20 g/l were charged in a mixer (Henschel mixer) as shown in FIG. 4, and mixed at a peripheral speed of 40 m/sec for 5 min., thereby to obtain a developer (c). The developer (c) showed a content A of 0.80 wt. % and a content B of 0.74 wt. %, whereby the value of B/A was 0.92.

By using the above-mentioned developer (c), an image formation test was conducted in the same manner as in Example 1. The results are shown in Table 1 appearing hereinafter.

As shown in Table 1, the resultant image density was 1.30 and was somewhat lower than that obtained in Example 1, but there were provided clear images without fog having a good resolution. Further, no filming phenomenon occurred even after successive image formation of 20,000 sheets.

EXAMPLE 3

100 parts of black fine powder prepared in the same manner as in Example 1 and 0.8 part of positively chargeable silicic acid fine powder (I) having a bulk density of 53 g/l were pre-mixed by means of the Nautor mixer. The resultant pre-mixed product was subjected to a mixing operation by means of a dry mixing device as shown in FIG. 6, under mixing conditions such that the number of stages of stirring vanes and fixed blades was 15 and the tip portion of the stirring vane had a peripheral speed of 50 m/sec, thereby to obtain a developer (d). The developer (d) showed a content A of 0.80 wt. % and a content B of 0.77 wt. %, whereby the value of B/A was 0.96.

By using the above-mentioned developer (d), an image formation test was conducted in the same manner as in Example 1. The results are shown in Table 1 appearing hereinafter.

As shown in Table 1, the developer (d) showed good developing characteristics without causing a filming phenomenon.

COMPARATIVE EXAMPLE 2

100 parts of black fine powder was subjected to a mixing operation in the same manner as in Example 1 except that 0.8 part of positively chargeable silicic acid fine powder (I) having a bulk density of 53 g/l silicic acid fine powder (II) having a bulk density of 20 g/l, thereby to obtain a developer (e). The developer (e) showed a content A of 0.80 wt. % but showed a content B of 0.68 wt. %, whereby the value of B/A was 0.85.

By using the above-mentioned developer (e), an image formation test was conducted in the same manner as in Example 2. The results are shown in Table 1 appearing hereinafter.

As shown in Table 1, the developer (e) provided good images in the initial stage but black spots due to a filming phenomenon on the photosensitive drum surface occurred in the resultant images at the time of about $1.8 \times 10^4$ sheets and thereafter. Further, after an image formation test of 20,000 sheets in total was conducted, the photosensitive drum was taken out and observed. As a result, it was found that a filming phenomenon due to the attachment and deposition of silicic acid fine powder (I) noticeably occurred with respect to the front side (i.e., on the side on which the developer was supplied to a developing device) of the photosensitive drum.

COMPARATIVE EXAMPLE 3

A developer (f) was prepared in the same manner as in Example 2 except that black fine powder and positively chargeable silicic acid fine powder (II) were mixed at a peripheral speed of 20 m/sec for 30 sec. The developer (f) showed a content A of 0.80 wt. but showed a content B of 0.70 wt. %, whereby the value of B/A was 0.88.

By using the above-mentioned developer (f), an image formation test was conducted in the same manner as in Example 2. The results are shown in Table 1 appearing hereinafter.

As shown in Table 1, the images provided by the developer (f) showed a high image density but showed noticeable fog and a poor resolution. Further, after an image formation test of 20,000 sheets in total was conducted, it was found that a filming phenomenon due to the attachment of silicic acid fine powder (II) somewhat occurred.

EXAMPLE 4

Silicic acid synthesized by a dry process (trade name Aerosil #200, mfd, by Nihon Aerosil K.K., specific surface area: about 200 $m^2/g$) was charged in a hermetic Henschel mixer heated to 70° C., and stirred at a high speed while γ-aminopropyltriethoxysilane as a treating agent diluted with alcohol was dripped thereto so that the above-mentioned silicic acid fine powder was treated with 4.0 wt. % of the treating agent. After the dripping was completed, the resultant mixture was dried at 120° C. while being stirred in the same manner, thereby to obtain positively chargeable silicic acid fine powder (III) having a bulk density of 45 g/l.

Then, a developer (g) was prepared in the same manner as in Example 1 except that 0.6 part of the above-mentioned positively chargeable silicic acid fine powder (III) was used instead of the positively chargeable silicic acid fine powder (II). The developer (g) showed a content A of 0.60 wt. % and showed a content B of 0.57 wt. %, whereby the value of B/A was 0.95.

By using the above-mentioned developer (g), an image formation test was conducted in the same manner as in Example 1. The results are shown in Table 1 appearing hereinafter.

As shown in Table 1 the developer (g) provided clear high-quality images with a high image density in the initial stage and did not cause a filming phenomenon on the photosensitive drum even after successive image formation of 20,000 sheets.

COMPARATIVE EXAMPLE 4

100 parts of black fine powder prepared in Example 1 and 0.6 part of positively chargeable silicic acid fine powder (III) having a bulk density of 45 g/l obtained in Example 4 were charged in a mixer as shown in FIG. 4, and mixed at a peripheral speed of 20 m/sec for 30 sec, thereby to obtain a developer (h). The developer (h) showed a content A of 0.60 wt. % but showed a content B of 0.51 wt. %, whereby the value of B/A was 0.85.

By using the above-mentioned developer (h), an image formation test was conducted in the same manner as in Example 1. The results are shown in Table 1 appearing hereinafter.

As shown in Table 1, the developer (h) provided good images in the initial stage but black spots due to a filming phenomenon on the photosensitive drum surface occurred in the resultant images at the time of about $1.6 \times 10^4$ sheets and thereafter. Further, after an image formation test of 20,000 sheets in total was conducted, the photosensitive drum was taken out and observed As a result, it was found that a filming phenomenon due to the attachment and deposition of silicic acid fine powder noticeably occurred with respect to the front side of the photosensitive drum.

TABLE 1

| | | | | | Initial image | | | | |
|---|---|---|---|---|---|---|---|---|---|
| | Developer | A wt. % | B wt. % | B/A | Dmax | Thin-line reproducibility (%) | Resolution (lines/mm) | Number*1 of copied sheets | Filming*2 |
| Ex. | | | | | | | | | |
| 1 | (a) | 0.80 | 0.78 | 0.98 | 1.40 | 1.05 | 7.1 | — | None |
| 2 | (c) | 0.80 | 0.74 | 0.92 | 1.30 | 1.05 | 6.3 | — | None |
| 3 | (d) | 0.80 | 0.77 | 0.96 | 1.34 | 1.07 | 6.3 | — | None |
| 4 | (g) | 0.60 | 0.57 | 0.95 | 1.33 | 1.04 | 7.1 | — | None |
| Comp. | | | | | | | | | |

TABLE 1-continued

| | Developer | A wt. % | B wt. % | B/A | Initial image Dmax | Thin-line reproducibility (%) | Resolution (lines/mm) | Number*1 of copied sheets | Filming*2 |
|---|---|---|---|---|---|---|---|---|---|
| Ex. | | | | | | | | | |
| 1 | (b) | 0.80 | 0.65 | 0.81 | 1.42 | 1.35 | 4.5 | about $0.8 \times 10^4$ | Observed |
| 2 | (e) | 0.80 | 0.68 | 0.85 | 1.33 | 1.07 | 7.1 | about $1.8 \times 10^4$ | Observed |
| 3 | (f) | 0.80 | 0.70 | 0.88 | 1.38 | 1.20 | 7.1 | about $2.0 \times 10^4$ | Somewhat observed |
| 4 | (h) | 0.60 | 0.51 | 0.85 | 1.34 | 1.04 | 7.1 | about $1.6 \times 10^4$ | Observed |

*1Number of copied sheets (at most 20,000) which had been obtained until a filming phenomenon occurred. The filming phenomenon was observed with the naked eye.
*2The filming phenomenon was evaluated at the time of successive copying of 20,000 sheets.

In the above Table 1, the thin-line reproducibility and the resolution were measured in the following manner.

THIN-LINE REPRODUCIBILITY

An original image comprising thin lines accurately having a width of 100 microns was copied under a suitable copying condition, i.e., a condition such that a circular original image having a diameter of 5 mm and an image density of 0.3 (halftone) was copied to provide a copy image having an image density of 0.3–0.5, thereby to obtain a copy image as a sample for measurement. An enlarged monitor image of the sample was formed by means of a particle analyzer (Luzex 450, mfd. by Nihon Regulator Co. Ltd.) as a measurement device, and the line width was measured by means of an indicator. Because the thin line image comprising toner particles had unevenness in the width direction, the measurement points for the line width were determined so that they correspond to the average line width, i.e., the average of the maximum and minimum line widths Based on such measurement, the value (%) of the thin-line reproducibility was calculated according to the following formula:

$$\frac{\text{Line width of copy image obtained by the measurement}}{\text{Line width of the original (100 microns)}} \times 100$$

RESOLUTION

There were formed ten species of original images comprising a pattern of five thin liens which had equal line width and were disposed at equal intervals equal to the line width. In these ten species of original images, thin lines were respectively drawn so that they provide densities of 2.8, 3.2, 3.6, 4.0, 4.5, 5.0, 5.6, 6.3, 7.1, and 8.0 lines per 1 mm. These ten species of original images were copied under the above-mentioned suitable copying conditions to form copy images which were then observed by means of a magnifying glass. The value of the resolution was so determined that it corresponded to the maximum number of thin lines (lines/mm) of an image wherein all the thin lines were clearly separated from each other. As the above-mentioned number is larger, it indicates a higher resolution.

EXAMPLE 5

200 g of positively chargeable silicic acid fine powder (I) (bulk density: 53 g/l) was disintegrated by means of an impact-type micronizer (Cosmomizer, mfd. by Nara Kikai Seisakusho K.K.) for about 30 sec, to obtain positively chargeable silicic acid fine powder (IV) having a bulk density of 38 g/l.

A developer (i) having a B/A value of 0.97 was obtained in the same manner as in Example 3 except that 0.8 part of the positively chargeable silicic acid fine powder (IV) was used. The resultant developer (i) showed better anti-filming property than that of the developer (d) obtained in Example 3.

EXAMPLE 6

Positively chargeable silicic acid fine powder (III) (bulk density: 45 g/l) was disintegrated by means of an impact-type micronizer to obtain positively chargeable silicic acid fine powder (V) having a bulk density of 29 g/l.

A developer (j) having a B/A value of 0.97 was obtained in the same manner as in Example 4 except that 0.6 part of the positively chargeable silicic acid fine powder (V) was used. The resultant developer (j) showed better anti-filming property than that of the developer (g) obtained in Example 4.

What is claimed is:

1. In a developer for developing electrostatic latent images, comprising a mixture of a toner and fine powder of silicic acid; the improvement wherein the fine powder of silicic acid is surface-treated and silicic acid fine powder particles having a size of less than 74 microns are present in amounts of at least 90% based on the total amount of the fine powder of silicic acid in the mixture.

2. A developer according to claim 1, wherein said toner has a particle size distribution such that it contains 12–60% by number of toner particles having a particle size of 5 microns or smaller, 1–33% by number of toner particles having a particle size of 8–12.7 microns, and 2.0% or less by volume of toner particles having a particle size of 16 microns or larger, and has a volume-average particle size of 4–10 microns, and the fine powder of silicic acid has a BET specific surface area of 30 $m^2/g$ or larger.

3. A developer according to claim 2, wherein the fine powder of silicic acid has a BET specific surface area of 50–400 $m^2/g$.

4. A developer according to claim 1, wherein in said mixture the silicic acid fine powder particles having a size less than 74 microns are present in amounts of at least 95%.

5. A developer according to claim 1, wherein the fine powder of silicic acid has been mixed in an amount of 0.01–8 wt. parts with respect to 100 wt. parts of the toner.

6. A developer according to claim 1, wherein the fine powder of silicic acid has been mixed in an amount of 0.1–5 wt. parts with respect to 100 wt. parts of the toner.

7. A developer according to claim 1, wherein said toner comprises a magnetic toner comprising a binder resin and a magnetic material.

8. A developer according to claim 7, wherein said magnetic toner contains 30–120 wt. parts of the magnetic material with respect to 100 wt. parts of the binder resin.

9. A developer according to claim 7, wherein said magnetic toner contains 40–110 wt. parts of the magnetic material with respect to 100 wt. parts of the binder resin.

10. A developer according to claim 1, wherein the fine powder of silicic acid comprises silicic acid fine powder surface-treated with a silicone oil.

11. A developer according to claim 1, wherein the fine powder of silicic acid has a bulk density of 40 g/l or lower.

12. A developer according to claim 1, wherein the fine powder of silicic acid has a bulk density of 15–30 g/l.

13. A developer according to claim 1, wherein the fine powder of silicic acid has been prepared by disintegrating fine powder of silicic acid having a bulk density of 50 g/l or higher so as to provide a bulk density of 40 g/l or lower.

14. A developer according to claim 1, wherein the fine powder of silicic acid has been prepared by disintegrating fine powder of silicic acid having a bulk density of 50 g/l or higher so as to provide a bulk density of 15–30 g/l.

15. A developer according to claim 1, wherein said toner comprises a positively chargeable magnetic toner and has a particle size distribution such that it contains 12–60% by number of toner particles having a particle size of 5 microns or smaller, 1–33 % by number of toner particles having a particle size of 8–12.7 microns, and 2.0% or less by volume of toner particles having a particle size of 16 microns or larger, and has a volume-average particle size of 4–10 microns; and the fine powder of silicic acid has a BET specific surface area of 30 $m^2/g$ or larger.

16. A developer according to claim 15, wherein the fine powder of silicic acid comprises silicic acid fine powder surface-treated with a silicone oil having a nitrogen atom in its side chain.

17. A developer according to claim 16, wherein the fine powder of silicic acid has a bulk density of 40 g/l or lower.

18. A developer according to claim 16, wherein the fine powder of silicic acid has a bulk density of 15–30 g/l.

19. A developer according to claim 16, wherein the fine powder of silicic acid has been prepared by disintegrating fine powder of silicic acid having a bulk density of 50 g/l or higher so as to provide a bulk density of 40 g/l or lower.

20. A developer according to claim 16, wherein the fine powder of silicic acid has been prepared by disintegrating fine powder of silicic acid having a bulk density of 50 g/l or higher so as to provide a bulk density of 15–30 g/l.

21. A developer according to claim 1, wherein the fine powder of silicic acid comprises silicic acid fine powder surface-treated with a silane coupling agent.

22. A developer according to claim 1, wherein the fine powder of silicic acid comprises silicic acid fine powder surface-treated with a nitrogen-containing silane coupling agent.

23. A developer according to claim 1, wherein the fine powder of silicic acid comprises silicic acid fine powder surface-treated with a silicone oil and a silane coupling agent.

24. A developer according to claim 15, wherein the fine powder of silicic acid comprises silicic acid fine powder surface-treated with a silicone oil having a nitrogen atom in its side chain and a nitrogen-containing silane coupling agent.

* * * * *

UNITED STATES PATENT AND TRADEMARK OFFICE

CERTIFICATE OF CORRECTION

PATENT NO. : 5,202,213

DATED : April 13, 1993

INVENTOR(S) : TOSHIAKI NAKAHARA, ET AL.

It is certified that error appears in the above-indentified patent and that said Letters Patent is hereby corrected as shown below:

COLUMN 1

Line 34, "2,221,776:" should read --2,221,776;--.

COLUMN 2

Line 26, "demanded" should read --demanded.--.

COLUMN 3

Line 11, "factors" should read --factors.--.

COLUMN 5

Line 27, "aperture" should read --aperture:--.

COLUMN 8

Line 30, "sample" should read --sample.--.
Line 32, "weighed" should read --weighed.--.

UNITED STATES PATENT AND TRADEMARK OFFICE

CERTIFICATE OF CORRECTION

PATENT NO. : 5,202,213

DATED : April 13, 1993

INVENTOR(S) : TOSHIAKI NAKAHARA, ET AL.

It is certified that error appears in the above-identified patent and that said Letters Patent is hereby corrected as shown below:

COLUMN 9

Line 8, "1.5 wt." should read --1.5 wt. %--.

COLUMN 12

Line 63, "and" should read --and ¶ trimethoxysilyl-γ-propylimidazole.--.

COLUMN 13

Line 8, "powder" should read --powder.--.
Line 48, "styrenep-chlorostyrene" should read --styrene-p-chlorostyrene--.
Line 52, "styreneacrylonitrile" should read --styrene-acrylonitrile--.
Line 55, "styrenebutadiene" should read --styrene-butadiene--.
Line 62, "coumaroneindene" should read --coumarone-indene--.

COLUMN 14

Line 9, "imagesupporting" should read --image-supporting--.
Line 15, "serious" should read --serious.--.
Line 54, "styreneisoprene" should read --styrene-isoprene--.

COLUMN 15

Line 24, "abovemen-" should read --above-men- --.

UNITED STATES PATENT AND TRADEMARK OFFICE

CERTIFICATE OF CORRECTION

PATENT NO. : 5,202,213

DATED : April 13, 1993

INVENTOR(S) : TOSHIAKI NAKAHARA, ET AL.

It is certified that error appears in the above-identified patent and that said Letters Patent is hereby corrected as shown below:

COLUMN 17

Line 8, "extruder" should read --extruder.--.
Line 20, "microns" should read --microns.--.
Line 58, "0.78 wt." should read --0.78 wt. %.--.
Line 59, close up left margin.

COLUMN 19

Line 17, "53 g/l silicic" should read --53 g/l was used instead of 0.8 part of positively chargeable silicic--.
Line 45, "0.80 wt." should read --0.80 wt. %.--.

COLUMN 20

Line 54, "observed" should read --observed.--.

COLUMN 21

Line 37, "widths" should read --widths.--.
Line 49, "liens" should read --lines--.

COLUMN 22

Line 42, "images," should read --images--.
Line 43, "acid;" should read --acid--.

--

UNITED STATES PATENT AND TRADEMARK OFFICE

CERTIFICATE OF CORRECTION

PATENT NO. : 5,202,213

DATED : April 13, 1993

INVENTOR(S) : TOSHIAKI NAKAHARA, ET AL.

It is certified that error appears in the above-identified patent and that said Letters Patent is hereby corrected as shown below:

COLUMN 24

Line 28, "claim 1," should read --claim 15,--.

Signed and Sealed this

Eighth Day of March, 1994

Bruce Lehman

*Attest:*

BRUCE LEHMAN

*Attesting Officer*

*Commissioner of Patents and Trademarks*